US006326572B1

(12) United States Patent
Yu

(10) Patent No.: US 6,326,572 B1
(45) Date of Patent: Dec. 4, 2001

(54) PUSH-BUTTON SWITCH ASSEMBLY

(76) Inventor: Tsung-Mou Yu, No. 4, Alley 2, Lane 23, Sec. 3, Pa Te Road, Panchiao, Taipei (TW)

( * ) Notice: Subject to any disclaimer, the term of this patent is extended or adjusted under 35 U.S.C. 154(b) by 0 days.

(21) Appl. No.: 09/654,238

(22) Filed: Sep. 2, 2000

(51) Int. Cl.[7] ..... H01H 13/56

(52) U.S. Cl. ..... 200/524; 200/533; 200/534; 200/535; 200/341

(58) Field of Search ..... 200/16 R–16 D, 200/520–524, 533–535, 341

(56) References Cited

U.S. PATENT DOCUMENTS

| | | | | |
|---|---|---|---|---|
| 4,167,720 | | 9/1979 | Krasser | 337/60 |
| 4,218,598 | * | 8/1980 | Iwasaki et al. | 200/153 J |
| 4,404,436 | * | 9/1983 | Ohba | 200/153 J |
| 4,531,026 | * | 7/1985 | Terajima et al. | 200/5 R |
| 4,543,459 | * | 9/1985 | Hayashida | 200/67 D |
| 4,827,087 | * | 5/1989 | Niinuma et al. | 200/5 E |
| 4,937,548 | | 6/1990 | Sdunek | 337/70 |
| 5,223,813 | | 6/1993 | Cambreleng et al. | 337/66 |
| 5,451,729 | | 9/1995 | Onderka et al. | 200/18 |
| 5,558,211 | | 9/1996 | Heydner et al. | 200/553 |
| 5,711,414 | * | 1/1998 | Nishitani et al. | 200/524 |
| 5,823,326 | * | 10/1998 | Saito et al. | 200/524 |
| 6,028,274 | * | 2/2000 | Harris | 200/52 R |

* cited by examiner

*Primary Examiner*—Michael Friedhofer

(57) ABSTRACT

A push-button switch assembly mainly comprises a push button, a switch casing, a positioning lever, and a resilient contact piece, wherein the push button is depressed for positioning a protruding portion of the positioning lever to interact with a, polygonal volute stairway mechanism disposed laterally in the push button, and the bottom end of the push button will prop or release the resilient contact piece directly to conductively actuate a power supply or not.

3 Claims, 9 Drawing Sheets

PUSH-BUTTON SWITCH ASSEMBLY

BACKGROUND OF THE INVENTION

1. Field of the Invention

This invention relates generally to a switch assembly, more particularly, it relates to a push-button switch assembly in simple structure for control of power supply by depressing a push button to oppress or release a resilient contact piece directly so as to simplify assembling process and reduce production cost.

2. Description of the Prior Art

A power switch is a widely used electronic component for ON/OFF control of a power supply, and is highlighted in its structural complexity in consideration of cost, and particularly, of its reliability of security.

So far, a variety of patents regarding switch assembly, including U.S. Pat. No. 4,167,720, 4,937,548, 5,223,813, 5,451,729, 5,558,211, etc, has already been disclosed, however, a common defect may be assigned to too many components and too complicated interaction of the switch assembly.

As illustrated in FIG. 1, when a prior push button 502 of a push-button switch rests at a top position, a contact point 506 of a conductive piece 504 is separated from a contact point 510 of a contact pin 508; and when the push button 502 is depressed to a lower position, a spring 514 and a protruding rod 512 disposed in the push-button switch will push the conductive piece 504 forward to enable the contact point 506 to contact with the contact point 510 of the contact pin 508 to have the switch turned "ON".

However, mechanical contact of the spring 514 and the protruding rod 512 will inevitably result in elastic fatigue and poor contact in the long run, besides, the top face of the push button 502 is somewhat insufficient for design of any reminding symbol or pattern as for promoting appended value.

SUMMARY OF THE INVENTION

The primary object of this invention is to provide a push-button switch assembly in simple structure for control of power supply by depressing a push button to oppress or release a resilient contact piece directly so as to simplify assembling process and reduce production cost.

Another object of this invention is to provide a push-button switch assembly, wherein a push-button cover is changeable in molding and in color to match background, to enrich color feeling, and to promote appended value.

Yet another object of this invention is to provide a push-button switch assembly with prolonged lifetime to reduce resource waste and product cost.

In order to realize abovesaid objects, the push-button switch assembly mainly comprises a push button, a switch casing, a positioning lever, and a resilient contact piece, wherein the push button is depressed for positioning a protruding portion of the positioning lever to interact with a polygonal volute stairway mechanism disposed laterally in the push button, and the bottom end of the push button will prop or release the resilient contact piece directly to conductively actuate a power supply or not.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE PREFERRED EMBODIMENT

Figure 1:
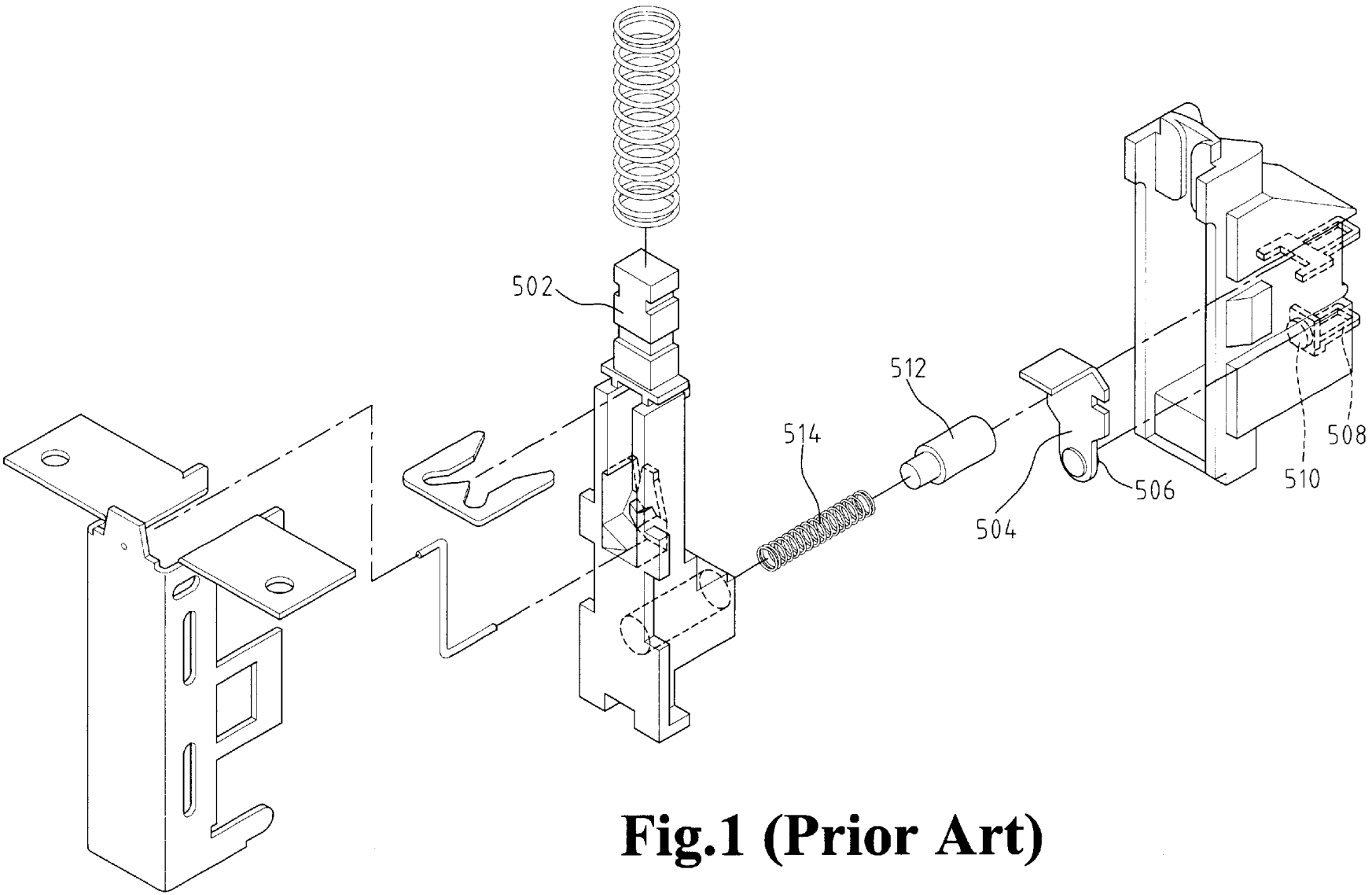
Fig.1 (Prior Art)
FIG. 1 is an exploded view of a prior art in three dimensions.
Figure 2:
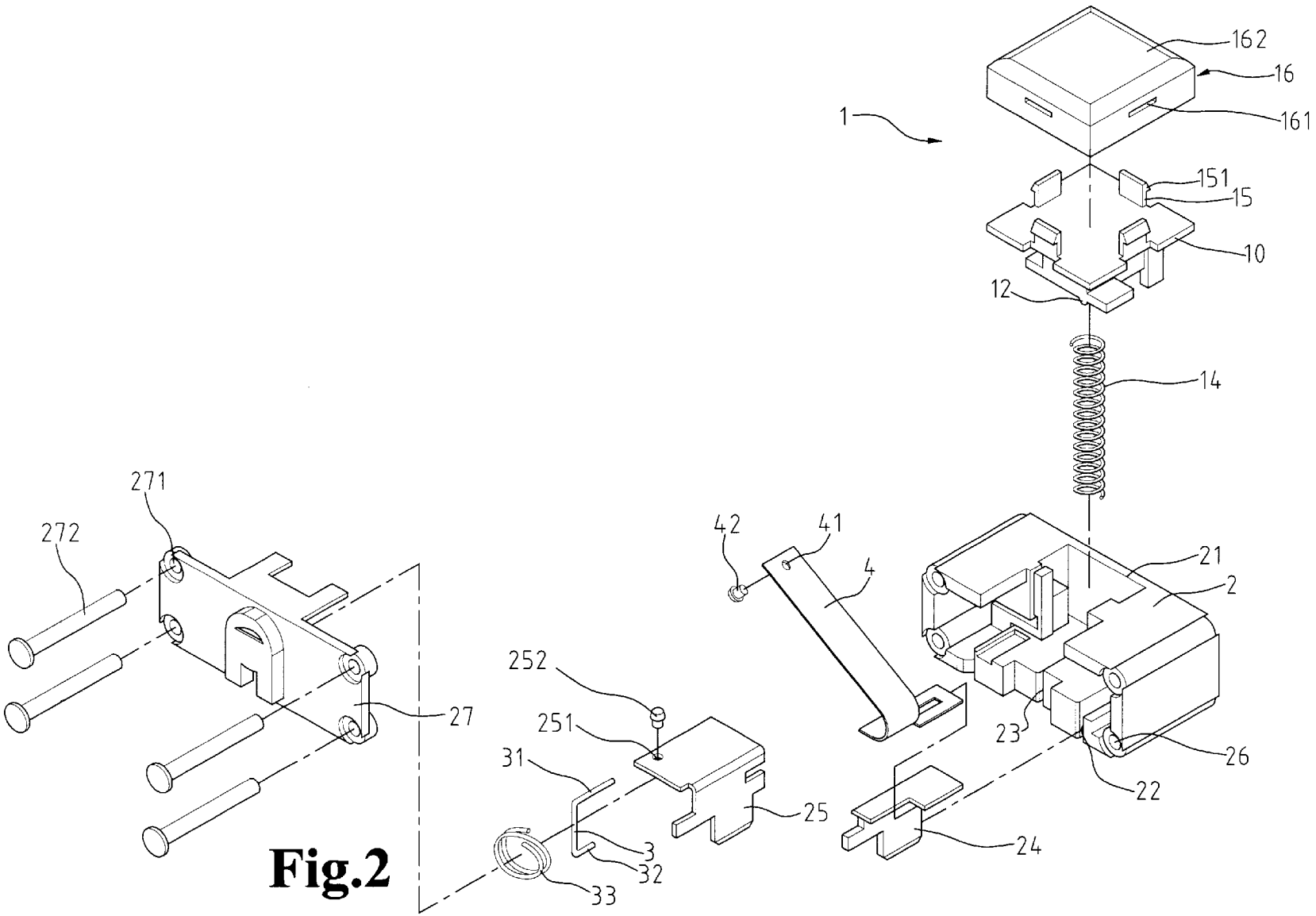
FIG. 2 is an exploded view of an embodiment of this invention in three dimensions.
Figure 3:
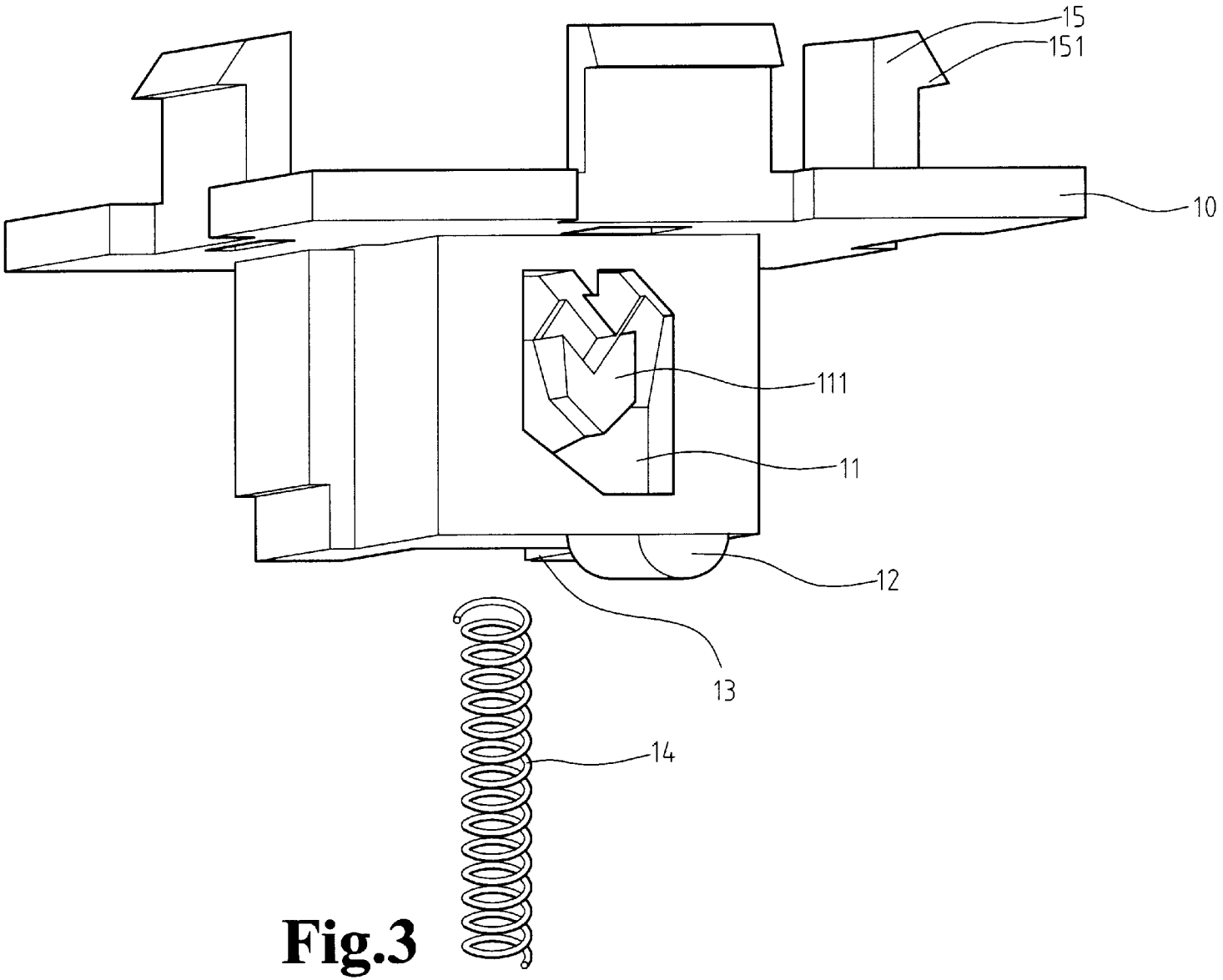
FIG. 3 is a perspective view of a push button in the embodiment of this invention.
Figure 4:
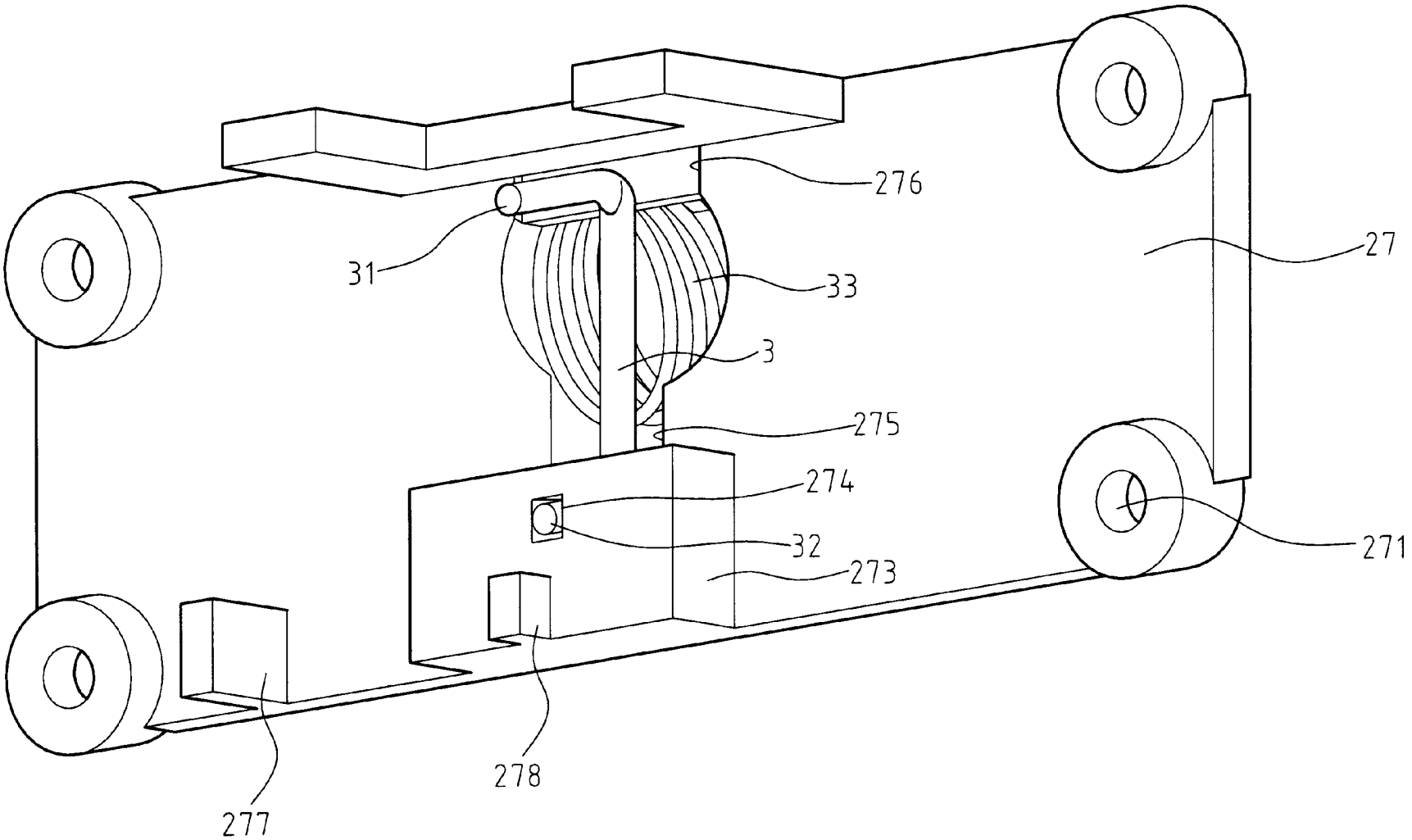
FIG. 4 is an inside lateral view of a push-button cover in three dimensions of the embodiment of this invention.

As illustrated in FIG. 2 through FIG. 4, a push-button switch assembly of this invention mainly comprises: a push button 1, a switch casing 2, a positioning lever 3, and a resilient contact piece 4.

The push button 1 further comprises a deck 10, a resilient member 14, and a push-button cover 16, wherein a polygonal volute stairway mechanism 11 is recessively and laterally disposed in a cabin under the deck 10; a <-shaped polygonal protrusion 111 is arranged in the volute stairway mechanism 11; an arcuate protuberance 12 and a groove 13 for reception of the resilient member 14 (a compressible spring in this invention) are formed at the bottom end or a lateral part of the cabin under the deck 10 respectively; a plurality of buckling columns 15 extended outwardly to form a snapping hook 151 apiece is disposed on the deck 10; a push-button face 162 of the push-button cover 16 installed on the deck 10 may be molded in different shapes, such as a quadrangle or a polygon, or colored with different pigments; and a retaining slot 161 corresponding to each snapping hook 151 is formed in a lateral wall of the push-button cover 16 individually.

The switch casing 2 is essentially a hollow body having an opened lateral wall, wherein an opening 21 is formed at the top end for accommodating the push button 1. A first and a second slot 22, 23 are trenched in the bottom face of the switch casing 2 for plugging and fixing a first and a second contact terminal 24, 25, wherein a point hole 251 is bored in the second contact terminal 25 for anchoring a lower contact point 252, and a plurality of combining pillars 26 is distributed to every comer of the switch casing 2 apiece. Moreover, a lateral opening of the switch casing 2 is covered with a shelter 27, which is provided with a plurality of combining holes 271 located at positions corresponding to that of the combining pillars 26 for riveting the shelter 27 to the switch casing 2 with rivets 272. Further, as shown in FIG. 4, a protruding block 273 is disposed at hill of an inner wall of the shelter 27, wherein a strut hole 274 is perforated in the protruding block 273; a through hole 275 is formed on the back of the protruding block 273; a fixing hole 276 is located above the through hole 275; and the shelter 27 together with the protruding block 273 are extended to form a first and a second positioning block 277, 278 respectively for being assembled to joint with the first and the second slot 22, 23 correspondingly.

The positioning lever 3 is substantially a ⊏-shaped pin comprising an upper protruding portion 31 and a lower supporting portion 32, wherein the supporting portion 32 is assembled to joint to the strut hole 274 after penetrating through the through hole 275 of the shelter 27. Meanwhile, a resilient member 33, a compressible spring in this invention, is assembled to joint with the fixing hole 276 of the shelter 27 behind the positioning lever 3 (according to FIG. 4) to provide a forward elastic force to the positioning lever 3 to enable the latter to sway back and forth or right and left slightly basing on the centered supporting portion 32.

The resilient contact piece 4 further comprises a point hole 41 for fitting an upper contact point 42 exactly above the lower contact point 252 of the second contact terminal 25 and a slant board clamped between the top end of the first contact terminal 24 and the bottom face of the switch casing 2.

Figure 5:
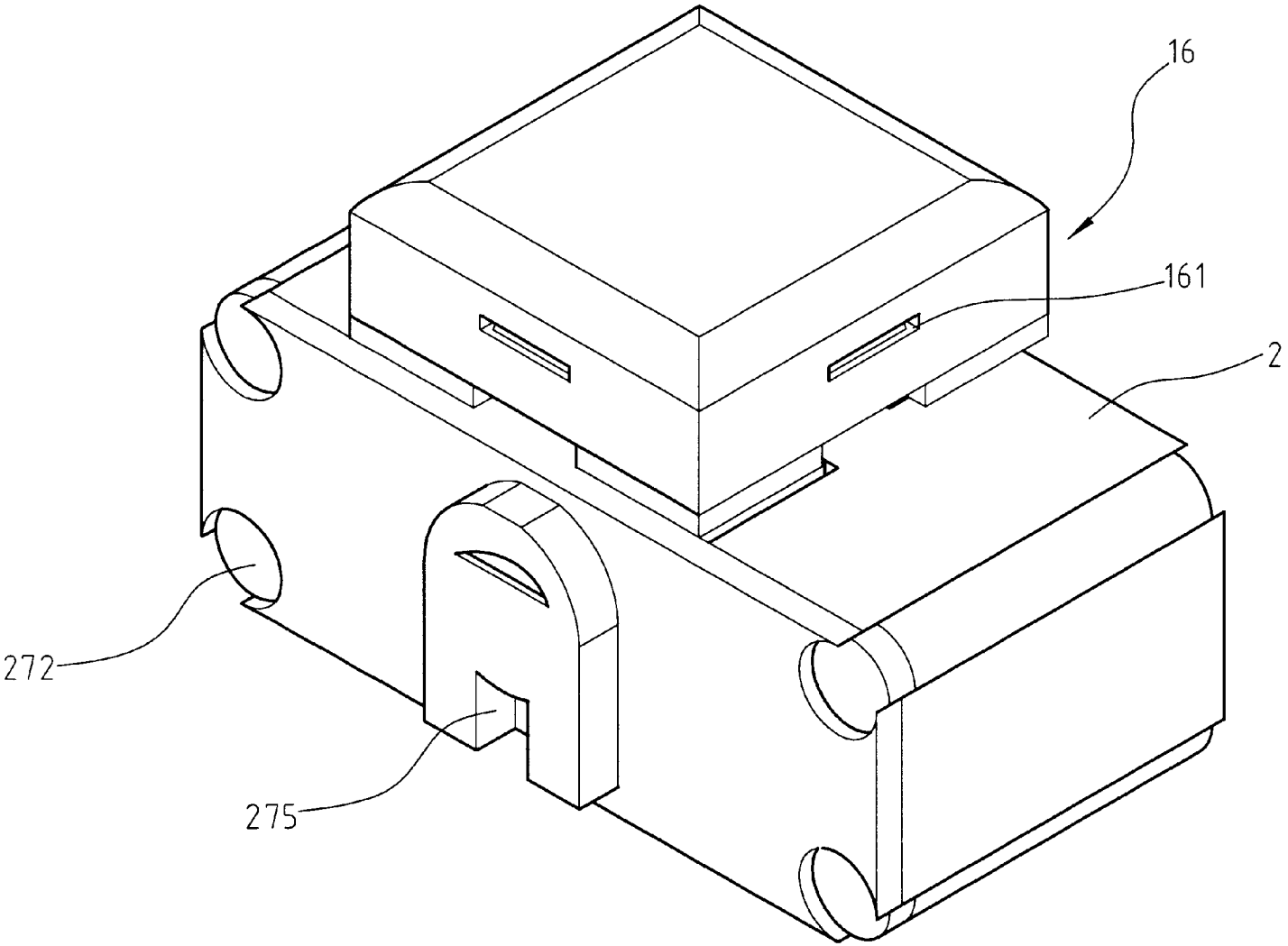
FIG. 5 is an elevational view of the embodiment of this invention in three dimensions.
Figure 6:
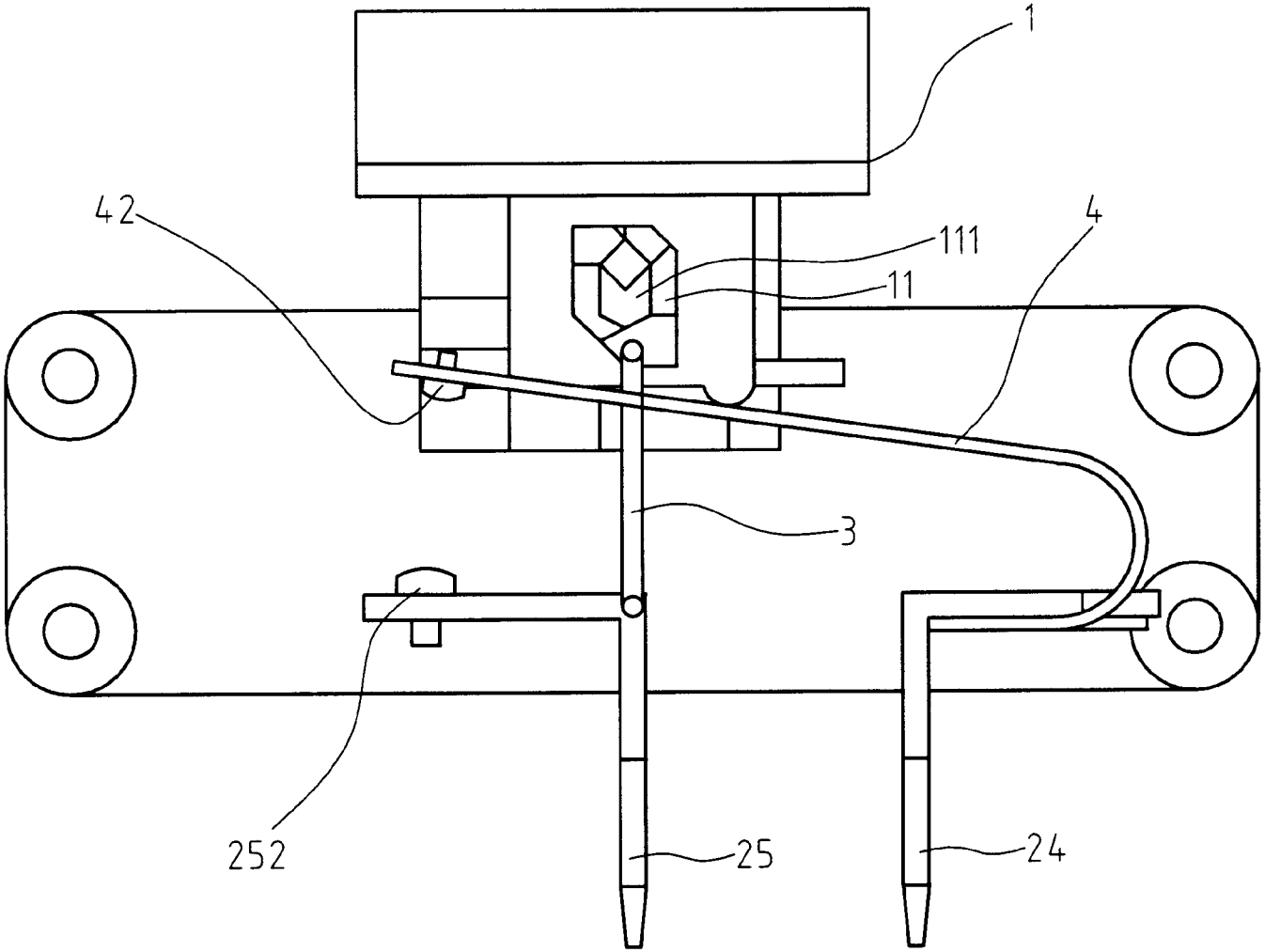
FIG. 6 is an assembled cutaway sectional view of the embodiment of this invention under power-off state.
Figure 8:
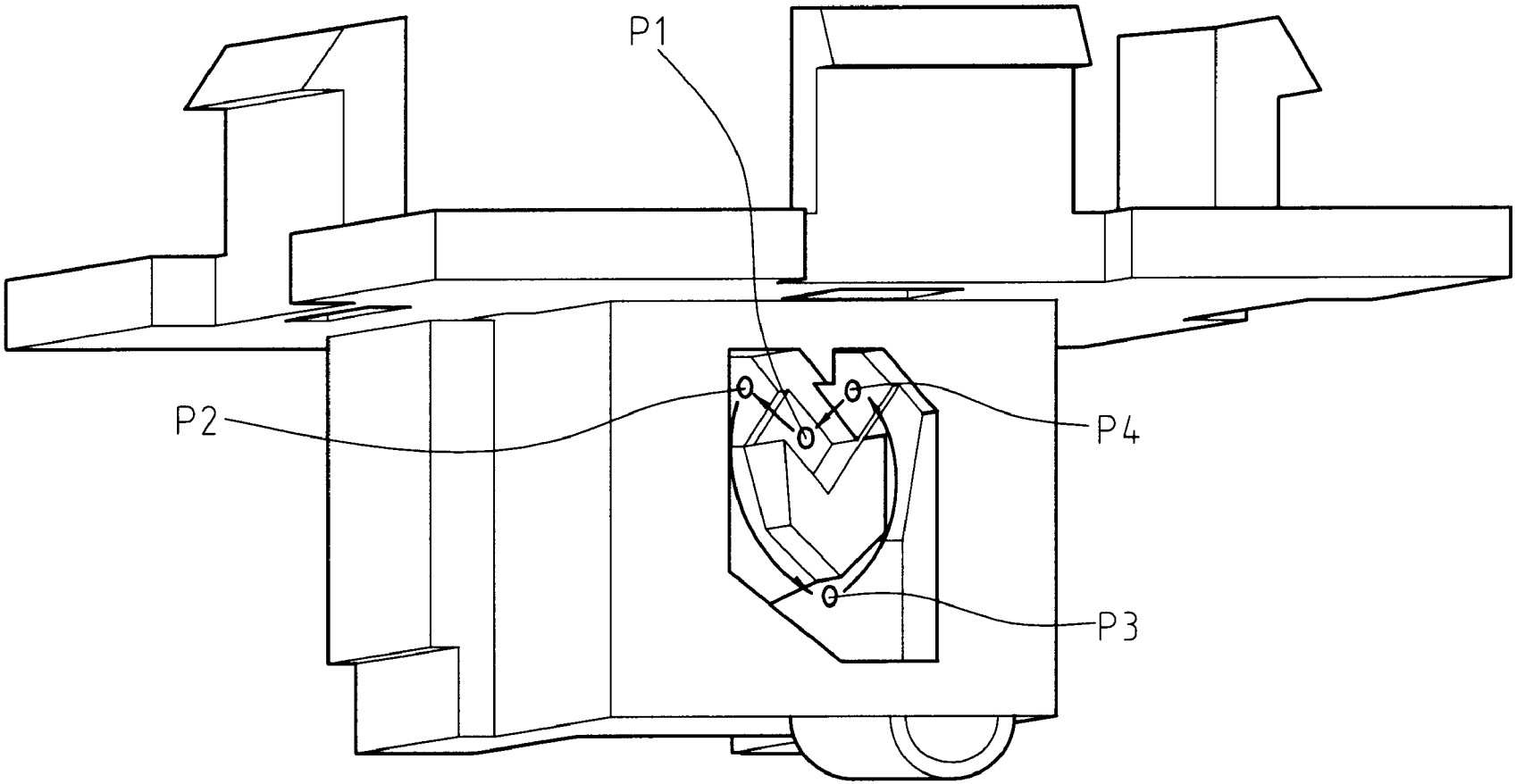
FIG. 8 is a perspective view of the embodiment of this invention showing relative positions of a volute stairway of the push button and an interactive protruding portion of a positioning lever.

As indicated in a power-off state shown in FIG. 6, and reference made to FIGS. 5 and 8, when a user depresses the push button 1, the resilient member 14 is compressed and deformed to accumulate restoring energy. Meanwhile, the resilient member 33 props and pushes one end of the protruding portion 31 of the positioning lever 3 to stab at a point P1 in the volute stairway mechanism 11, then turn to a next point P2 because of the steeper stairs at the right hand. Now, if the user's force is released, the restoring force of the resilient member 14 will impulse the push button 1 upwardly to allow the protruding portion 31 to reach a point P3 along the path in the volute stairway mechanism 11. Now the resilient contact piece 4 departs from constrain of the arcuate protuberance 12 of the push button 1 and bounces upwardly so that the upper contact point 42 separates from the lower contact point 252 to cut off the power supply.

Figure 7:
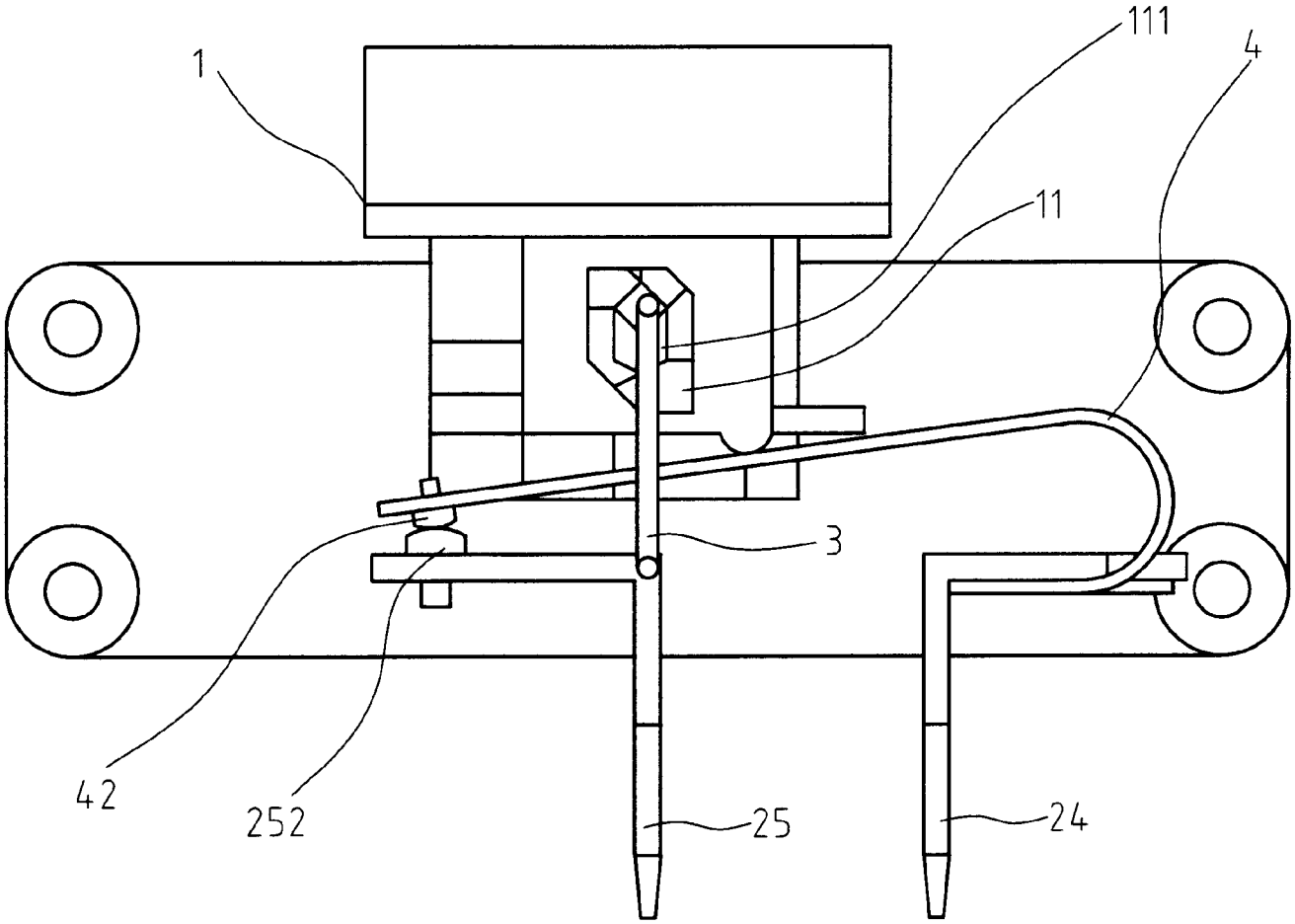
FIG. 7 is an assembled cutaway sectional view of the embodiment of this invention under power-on state.

Please refer to a cutaway sectional view of power-on state shown in FIG. 7, as well as FIG. 8. When a user depresses the push button 1 under a power-off state, the push button 1 will compress the resilient member 14 to accumulate restoring energy, meanwhile, one end of the protruding portion 31 of the positioning lever 3 in the volute stairway mechanism 11 is propped and pushed by the resilient member 33 to stab at the point P3 of the volute stairway mechanism 11, then turn to a point P4 along path of the volute stairway mechanism 11 because of the steeper stairs at the left hand. When the user's force is released, the push button 1 is driven to bounce upwardly by the restoring force of the resilient member 14 to allow the protruding portion 31 to slide along the path of the volute stairway mechanism 11 to the point P1. At this moment, the arcuate protuberance 12 at the bottom face of the push button 1 oppresses the resilient contact piece 4 to move downward to have the upper contact point 42 contacted with the lower contact point 252 to build up a circuit available through the first contact terminal 24, the resilient contact piece 4, the upper contact point 42, the lower contact point 252, and the second contact terminal 25.

In short, when such a simple mechanism of this invention is applied, the push button 1 is depressed to be positioned in a downward or upward state depending on the interactive relationship between the volute stairway mechanism 11 and the protruding portion 31 of the positioning lever 3, wherein the push button 1 can directly oppress or release the resilient contact piece 4 to form a power-on or power-off state.

Figure 9:
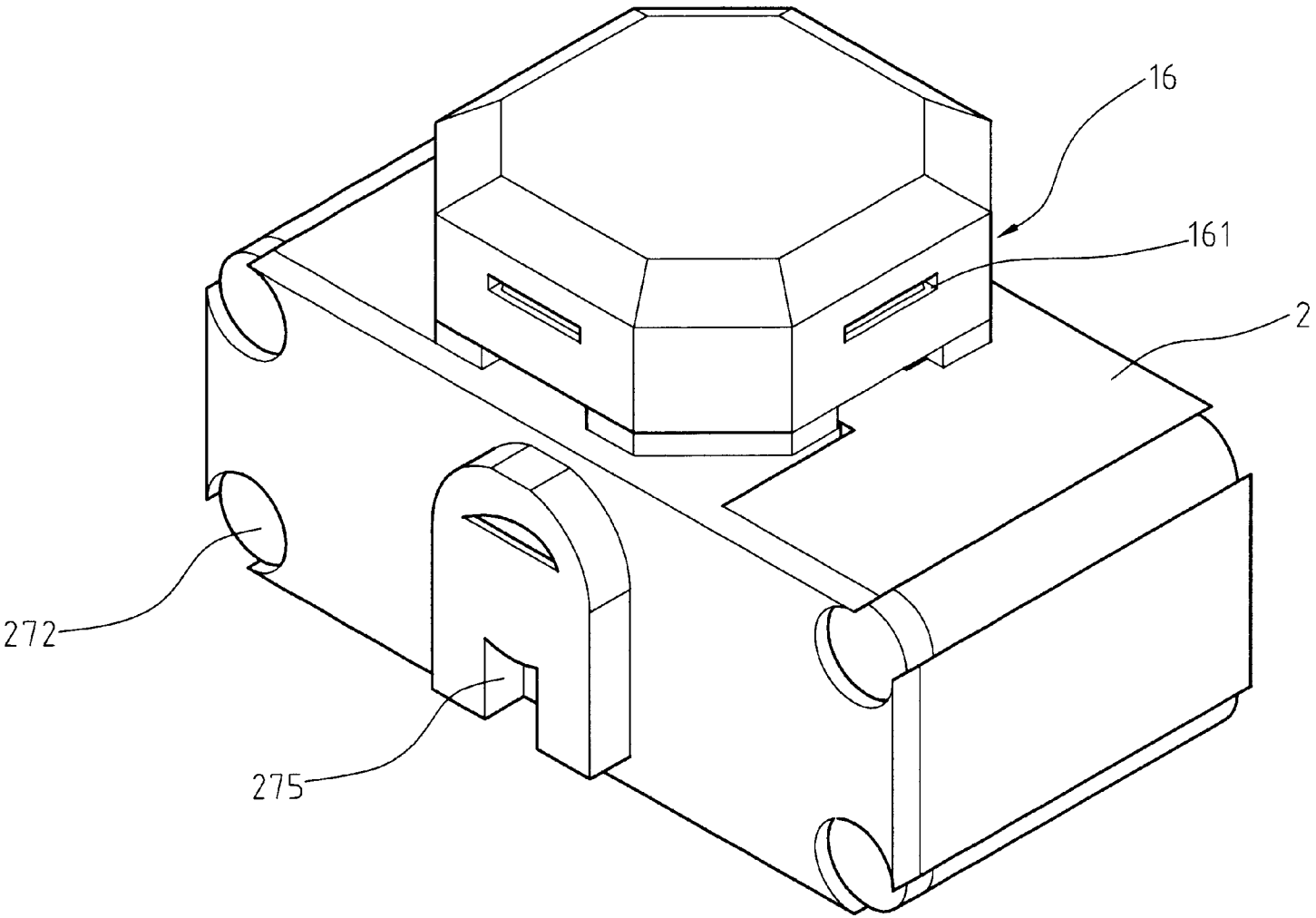
FIG. 9 is a schematic view of the embodiment of this invention showing another kind of push-button cover assembly.

Moreover, the buckling columns 15 and the outwardly extended snapping hooks 151 on the deck 10 may be paired with the push-button cover 16 in a variety of moldings or colors as wish (shown in FIG. 9) for promotion of appended value.

Although, this invention has been described in terms of preferred embodiments, it is apparent that numerous variations and modifications may be made without departing from the true spirit and scope thereof, as set forth in the following claims.

What is claimed is:

1. A push-button switch assembly, comprising:

a push button having a deck, a push-button cover above said deck, and a cabin formed under said deck, said cabin including a polygonal volute stairway mechanism disposed recessively on a side surface, a bottom groove for receiving a first resilient member, and a bottom arcuate protuberance;

a switch casing having a top opening for accommodating said push button, and a bottom surface formed with first and second slots for plugging and fixing first and second terminals;

a resilient contact piece housed in said switch casing, said resilient contact piece having a fixed end anchored on said first terminal, a resilient body bent underneath said bottom arcuate protuberance and a free end formed with a first contact point for contacting a second contact point formed on second terminal;

a shelter for covering a lateral opening of said switch casing, said shelter having a fixing hole, a through hole, and a protruding block formed with a strut hole;

a second resilient member disposed in said fixing hole; and a positioning lever having a supporting portion being received in said strut hole of said protruding block, and a protruding portion penetrating through said through hole of said shelter, said positioning lever being pushed by said second resilient member to dispose said protruding portion in said polygonal volute stairway mechanism when said shelter covers said switching casing;

wherein said resilient contact piece is pushed down by said bottom arcuate protuberance for connecting said first contact point and said second contact point when said push button is pressed to engage said protruding portion of said positioning lever in a first position within said polygonal volute stairway mechanism, and said resilient contact piece is released by said bottom arcuate protuberance for disconnecting said first contact point and said second contact point when said push button is pressed again to engage said protruding portion of said positioning lever in a second position within said polygonal volute stairway mechanism.

2. The push-button switch assembly as claimed in claim 1, wherein said first resilient member is a compressible spring.

3. The push-button switch assembly as claimed in claim 1, wherein said second resilient member is a compressible spring.

* * * * *